United States Patent [19]

Kelly

[11] Patent Number: 4,503,631

[45] Date of Patent: Mar. 12, 1985

[54] BLOW-THROUGH PIVOTAL SIGN

[76] Inventor: Gerard T. Kelly, 7280 Wynnwood, Ste. 275, Houston, Tex. 77008

[21] Appl. No.: 426,987

[22] Filed: Sep. 29, 1982

[51] Int. Cl.[3] ..... G09F 7/00

[52] U.S. Cl. ..... 40/602; 40/613

[58] Field of Search ..... 40/602, 608, 613; 52/98

[56] References Cited

U.S. PATENT DOCUMENTS

| | | | |
|---|---|---|---|
| 928,534 | 7/1909 | O'Brien | 40/624 |
| 965,111 | 7/1910 | Kemper | 49/10 |
| 1,449,063 | 3/1923 | Shotwell | 40/613 |
| 1,750,118 | 3/1930 | Mueller, Jr. et al. | 40/602 |
| 1,823,404 | 9/1931 | Marx et al. | 40/613 |
| 1,889,910 | 12/1932 | Weamer | 40/624 |
| 2,084,818 | 6/1937 | Neil | 40/613 |
| 2,746,187 | 5/1956 | Ennever | 40/624 |
| 2,800,734 | 7/1957 | Blackburn | 40/463 |
| 2,841,902 | 7/1958 | Pfundt | 40/602 |
| 3,120,069 | 2/1964 | Pfaff, Jr. et al. | 40/624 |
| 3,201,841 | 8/1965 | Carleton | 40/624 |
| 3,280,521 | 10/1966 | Keathly | 52/40 |
| 3,521,390 | 7/1970 | Carlson | 40/602 |
| 3,638,341 | 2/1972 | Holmes | 40/479 |
| 3,662,482 | 5/1972 | Sarkisian | 40/602 |
| 3,899,843 | 8/1975 | Doyle et al. | 40/602 |

*Primary Examiner*—Robert P. Swiatek
*Assistant Examiner*—Cary E. Stone
*Attorney, Agent, or Firm*—Arnold, White & Durkee

[57] ABSTRACT

A blow-through pivotal sign for preventing damage to advertising structures are the like. The blow-through pivotal sign comprises a signboard attached to a support structure to allow the signboard to rotate along a horizontal or vertical axis. The blow-through pivotal sign also comprises a mechanism for retaining the signboard in a fixed position until a preselected torque due to windload is applied as well as a wind responsive retractor for retracting the retaining mechanism to prevent damage thereto after the signboard has been deflected from the fixed position and is swinging freely.

13 Claims, 8 Drawing Figures

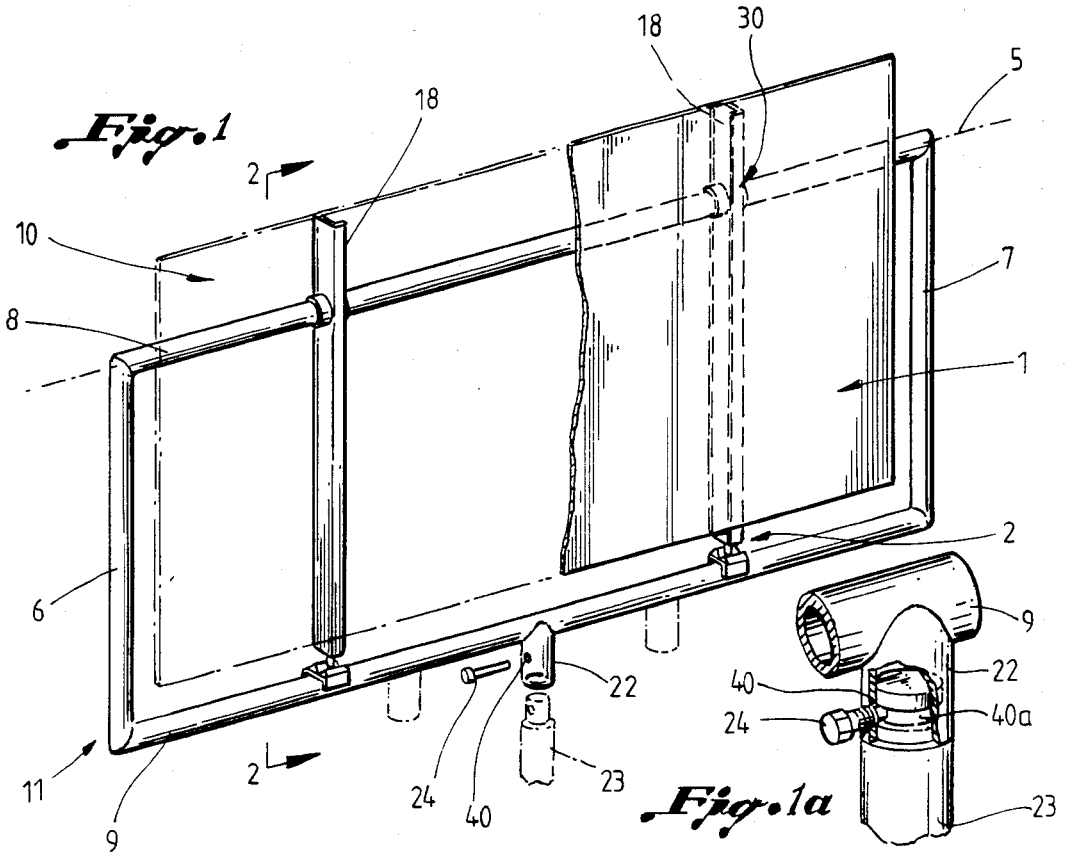
Fig. 1
18
30
5
18
2
10
7
8
1
2
6
9
22
40
22
24
40a
11
2
24
40
23
23
9
Fig. 1a
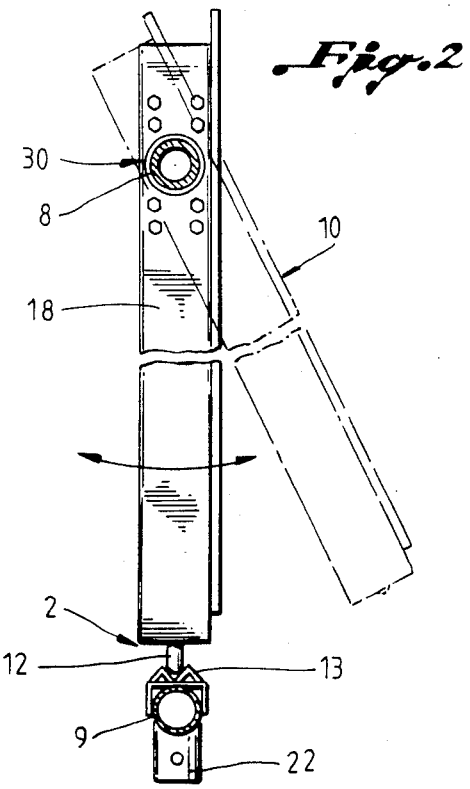
Fig. 2
30
8
10
18
2
12
13
9
22
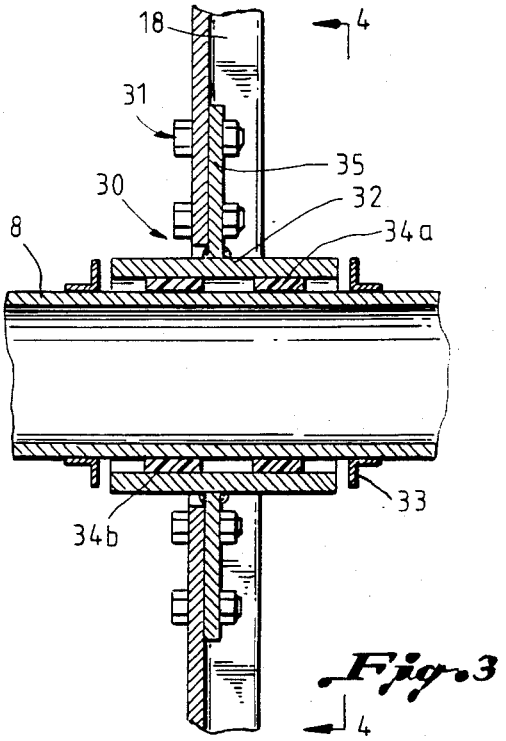
18
4
31
35
30
32
8
34a
33
34b
Fig. 3
4

BLOW-THROUGH PIVOTAL SIGN

BACKGROUND OF THE INVENTION

The present invention relates generally to signs, outdoor advertising structures, and the like. More particularly, the present invention relates to an improved apparatus that allows a signboard to be displaced from a fixed position after a preselected torque due to windload is applied as well as to a wind responsive retractor that retracts the retaining device to prevent damage to the retaining device after the sign has been deflected from its fixed position.

Conventional prior art utilizes two basic approaches to prevent wind damage to advertising structures and the like. The first approach is to divide the face of the signboard into subsections. Each subsection is then deflected when engaged by a sufficient force due to wind load. The apparent theory behind the divided signboards is to significantly reduce the force on each subsection of the signboard thereby reducing the chance of wind damage. The subsections of the divided face signboards have usually been designed to be deflected along either a vertical or horizontal axis. Signboards designed in subsections to be deflected when engaged by a sufficient force due to wind load have problems in displaying a continuous advertising message. Also such signboards can be extremely complicated and expensive to build and maintain.

Other prior art has attempted to circumvent these difficulties by designing a swing-free signboard where the signboard is of unitary construction. Designs vary greatly. Wind activated signs have been utilized with single signboards that merely swing from a pivotal mechanism on a support structure to allow the signboard to be deflected due to wind load at loads lower than that which would damage the structure. Other, more complex devices, have been utilized that unlock a signboard from a support structure when engaged by a sufficient force due to wind load and, thereafter, the locking mechanism can be reengaged to secure the signboard to the support structure. A basic problem with a sign comprising a single swing-free signboard is if the sign returns to its vertical or original position, due to a reduction in the magnitude of the wind force against the face of the signboard or due to a change in wind direction, contact is made between the securing device and the support structure. Such contact can cause damage to the release mechanism as well as the sign.

It is, therefore, a feature of the present invention to prevent damage due to strong winds or winds accompanied by precipitation to outdoor advertising structures and the like. The present invention provides a simple and inexpensive device that is exceedingly effective for which it is designed.

Another feature of the present invention is to provide a signboard that releases from a fixed position when a preselected torque due to windload is applied. The invention allows the sign to swing freely after release without requiring the securing mechanism to contact the support structure.

Yet another feature of the present invention is the ability to utilize the invention with a variety of signs of differing sizes. Also, the present invention can be used to modify already built signs of various sizes.

A further feature of the present invention is the utilization of a locking device that allows the signboard to release when a preselected torque due to windload is applied to the face of the signboard. The locking device can be adjusted for varying the magnitude of the force required to release the mechanism.

Yet further the present invention allows for rotation in either direction about a pivotal axis. After the securing mechanism has released, the signboard has total and free movement about the axis of rotation without the locking mechanism engaging any other part of the sign.

Still further the present invention can be easily reset after release of the locking device. It may be purchased, installed and maintained inexpensively. Also, the present invention utilizes minimal material and requires little effort to maintain.

Additional features and advantages of the invention will be set forth in part in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

The present invention overcomes the difficulties of the prior art. It is a blow-through pivotal sign provided for preventing damage to advertising structures due to high winds or a combination of winds and precipitation which comprises a signboard attached to a support structure, a mechanism for retaining the signboard in a fixed position until a preselected torque due to windload is applied, and a wind responsive retractor for retracting the retaining mechanism to prevent damage to the mechanism after the signboard has been deflected from the fixed position and is swinging freely.

Further refinement of the present invention provides a retaining mechanism which comprises a retaining member, a positive clutch, and a securing member. A retaining member engages a positive clutch mechanism to hold the signboard in a fixed position until a preselected torque due to windload is applied. The positive clutch mechanism is attached to the support structure. A securing member secures the retaining member until a torque on the pivotal signboard due to the wind force exceeds a preselected valve is exceeded. When the force on the signboard is large enough the retaining member disengages from the positive clutch mechanism and allows the signboard to be deflected from a fixed position.

In another sense, applicant's invention comprises a wind responsive retractor that can be used to modify existing signs to become a blow-through pivotal sign.

It is preferred that the wind responsive retractor for use with a blow-through pivotal sign include a retaining member for securing the position of the signboard until a preselected torque due to windload is applied, an elastic element and means for withdrawing and securing the retaining member for preventing damage to the retaining member as the sign is allowed to swing freely.

BRIEF DESCRIPTION OF THE DRAWINGS

The accompanying drawings, which are incorporated in and constitute a part of the specification, illustrate a preferred embodiment of the invention and, together with the general description of the invention given above and the detailed description of the preferred embodiment given below, serve to explain the principles of the invention.

FIG. 1 is a perspective view of an advertising sign practicing the present invention;

FIG. 1*a* is an alternate embodiment for maintaining the position of the signboard about the axis through the stanchion;

FIG. 2 is a cross-sectional view taken along the section line 2—2 in FIG. 1 showing the signboard in an engaged and disengaged position;

FIG. 3 is a longitudinal cross-sectional view of the mechanism that supports the signboard in FIG. 1;

Figure 4:
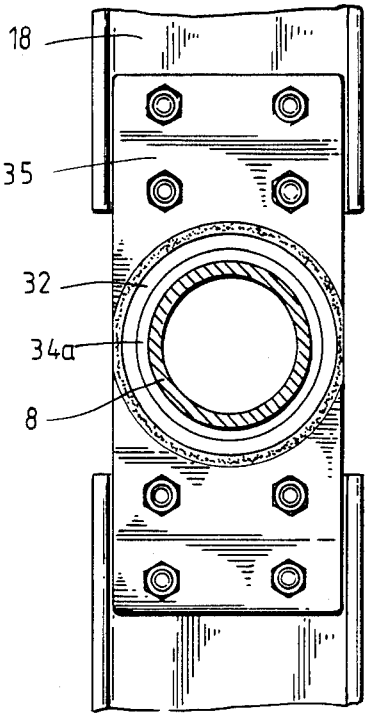
FIG. 4 is a cross-sectional view taken along the section line 4—4 in FIG. 3 depicting the concentric relationship of the mechanism that supports the signboard.

The above general description and the following detailed description are merely illustrative of the generic invention, and additional modes, advantages, and particulars of this invention will be readily suggested to those skilled in the art without departing from the spirit and scope of the invention.

DESCRIPTION OF THE PREFERRED EMBODIMENT

Reference will now be made in detail to the present preferred embodiment of the invention as described in the accompanying drawings.

FIG. 1 shows a perspective view which illustrates a preferred embodiment of a blow-through pivotal sign practicing the teachings of the present invention. In the preferred embodiment, the present invention provides for blow-through pivotal sign 1 which releases when a preselected torque due to windload is applied to signboard 10. The invention thereafter allows signboard 10 to pivot freely about its rotational axis 5 without engaging support structure 11.

In the particular device illustrated in FIG. 1, support structure 11 is held in a rigid, upright position by stanchion 23. Support structure 11 is defined by parallel vertical support members 6 and 7 and parallel horizontal support members 8 and 9 each joined at opposite ends to the support members 6 and 7. Horizontal member 9 and vertical members 6 and 7 form a partial perimeter about signboard 10.

Signboard 10 is attached to support structure 11 by support channels 18 and support mechanisms 30. Support channels 18 are vertically attached to signboard 10 extending a small distance therebeyond. Support channel 18 is attached to the top horizontal member 8 of support structure 11 by support mechanism 30 which allows support channel 18 to maintain a vertical position prior to rotation about axis 5. The exact support mechanism is not critical to the present invention. Support can be accomplished by a plurity of support channels 18 and a nylon bushing device as described below or any other suitable mechanism with the required characteristics.

In accordance with the present invention, wind responsive retractor 2 is utilized at the bottom of support channel 18. Wind responsive retractor 2 is mechanically mounted for movement in support channel 18 and operatively associated with support structure 11. FIG. 1 shows sign 1 utilizing a plurity of support channels 18, each associated with signboard 10 and support structure 11. In the bottom of each support channel 18 wind responsive retractor 2 is mechanically mounted to be operatively associated with support structure 11. Support channels 18 can be vertically associated with support structure 11, as shown in FIG. 1, or horizontally associated with support structure 11 allowing wind responsive retraction 2 to engage vertical members 6 and 7.

In FIG. 1, sign 1 is supported by single stanchion 23. Single stanchion 23 is inserted into sleeve 22 which is rigidly affixed to support structure 11. When stanchion 23 is engaged with sleeve 22, holes in both align to form channel 40. Securing member 24 is inserted into channel 40. Stanchion 23 and sleeve 22 act as a shearing mechanism against securing member 24. Thus as wind force acts on the longitudinal extremities of signboard 10, a torque is created about an axis of rotation through stanchion 23. When the torque due to wind load reaches a predetermined value, the shearing mechanism comprising stanchion 23 and sleeve 22 acting against securing member 24 result in the separation of securing member 24. When securing member 24 is separated, sign 1 can freely rotate about the axis through stanchion 23. Securing member 24 is designed to separate when the shearing force exerted by stanchion 23 and sleeve 22 reach a predetermined value.

An alternate embodiment is illustrated in FIG. 1*a*. The stanchion 23 is inserted into sleeve 22 which is rigidly affixed to support structure 11. When stanchion 23 is engaged with sleeve 22, channel 40 is aligned with the groove 40*a* to accept securing member 24. Securing member 24 passes in and around the groove 40*a* as the signboard 10 is forced to rotate about the axis through stanchion 23 because of torque due to windload.

FIG. 2 is a cross-sectional view taken along the section line 2—2 in FIG. 1 showing the signboard in an engaged vertical position and a disengaged off-vertical position. Support mechanism 30 is shown at the top of FIG. 2. Associated therewith is horizontal member 8 which passes through support channel 18 engaging support mechanism 30. Support mechanism 30 acts as a pivotal point for an axis of rotation through the center of horizontal member 8. When the force due to wind load on signboard 10 is sufficient, the structure comprising signboard 10 and support channel 18 is blown from a substantially vertical position to a displaced position as shown in FIG. 2. Support mechanism 30 allows the torque created by the wind forces acting on signboard 10 to cause the structure consisting of support channel 18 and signboard 10 to rotate about the axis passing through the center of horizontal member 8.

Wind responsive retractor 2 is also shown in FIG. 2. When signboard 10 is in a substantially vertical and secured position, wind responsive retractor 2 is operatively associated with support structure 11. Specifically, as shown in FIG. 2, retaining member 12 engages positive clutch mechanism 13. Positive clutch mechanism 13 is rigidly affixed to horizontal member 9. When a predetermined force due to wind load on signboard 10 causes a sufficient torque about the axis through horizontal member 8, wind responsive retractor 2 is activated. Retaining member 12 is withdrawn into support channel 18 thereby disengaging positive clutch mechanism 13. The withdrawal of retaining member 12 allows the structure consisting of support channel 18 and signboard 10 to swing freely about the axis of rotation through horizontal member 8. Thus, when a torque due to a predetermined wind load on signboard 10 is reached, the wind responsive retractor is activated, retaining member 12 is withdrawn into support channel 18, the structure consisting of signboard 10 and support channel 18 is displaced from a substantially vertical and secured position to a displaced position as shown in FIG. 2. Thereafter, the structure can swing back through the vertical position to a reciprocal displaced position in a free flowing unrestrained path.

FIG. 3 is a longitudinal cross-sectional view of support mechanism 30. Support mechanism 30 is rigidly affixed to support channel 18 by bolts 31. Bolts 31 secure support mechanism 30 by passing through support channel 18 and collar support 35. Collar support 35 is orthogonal to the central axis of cylindrical collar 32. Cylindrical bushings 34*a* and 34*b* are rigidly attached to the interior of collar 32 and actively engage horizontal member 8. The material used to fabricate bushings 34*a* and 34*b* allow horizontal member 8 to maintain its positional, vertical and rotational, relationship with collar 32. The present invention utilizes nylon for bushings 34*a* and 34*b*. Flanges 33 are rigidly attached to horizontal member 8 to maintain the longitudinal position of support channel 18 to horizontal member 8.

FIG. 4 is a cross-sectional view taken along the section line 4—4 in FIG. 3 depicting the concentric relationship of support mechanism 30 and its associated parts. Horizontal member 8 is abutted by bushing 34*a* to allow for free moving rotational motion therebetween. Collar 32 has bushings 34*a* and 34*b* rigidly attached to the inner circumference and collar support 35 orthogonally disposed and fixedly attached to the outer circumference. When a torque due to wind load on the surface of signboard 10 reaches a predetermined value disengaging retaining member 12 from positive clutch mechanism 13, signboard 10 and support channel 18 will be readily displaced from a substantially vertical position due to the ease of rotational movement and lack of friction between bushings 34*a* and 34*b* and horizontal member 8.

Figure 5:
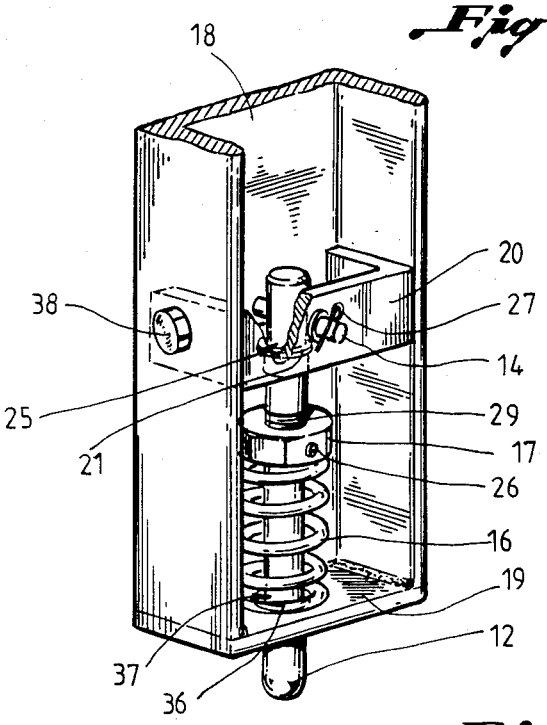
FIG. 5 is an axonometric projection of the wind responsive retractor in a mode to secure the signboard in a fixed position.

FIG. 5 is an axonometric projection of wind responsive retractor 2. Wind responsive retractor 2 is shown in an engaging mode. Retaining member 12 extends from support channel 18 past guide plate 19 for engaging positive clutch mechanism 13 on associated support structure 11 thereby securing signboard 10 and preventing the rotational movement thereof.

Retaining member 12 is inserted into holes 25 and 37. Holes 25 and 37 contain bushings 21 and 36, respectively. Bushings 21 and 36 allow retaining member 12 to move freely within the channel created by holes 25 and 37. Elastic element 16 acts against guide plate 19 and tension adjuster 17 with a force that tends to withdraw retaining member 12 into support channel 18. Elastic element 16 is restricted from withdrawing retaining member 12 by shearing member 14. Securing member 14 is inserted in a channel comprising holes in guide member 20, securing member 14 and supporting channel 18. Guide member 20 is secured to support channel 18 by bolts 38 and 39 (the latter not shown in FIG. 5). Securing member 14 is held in place by a flared end at one extreme and clip 27 at the other extreme. Guide member 20, support channel 18 and retaining member 12 act as a shearing mechanism against securing member 14. The shearing of member 14 is initiated when retaining member 12 acting against positive clutch mechanism 13 is forced into the confines of support channel 18 due to the torque created by the wind force acting on signboard 10.

Retaining member 12 is secured in a retracted mode by the force of elastic element 16 acting against tension adjuster 17 and guide plate 19. The force with which elastic element 16 acts against retaining member 12 can be adjusted by tension adjuster 17. Tension adjuster 17 can be moved along retaining member 12 by threads 29. When the desired tension is acquired on elastic element 16, tension adjuster 17 is secured by tightening set screw 26 against retaining member 12.

Figure 6:
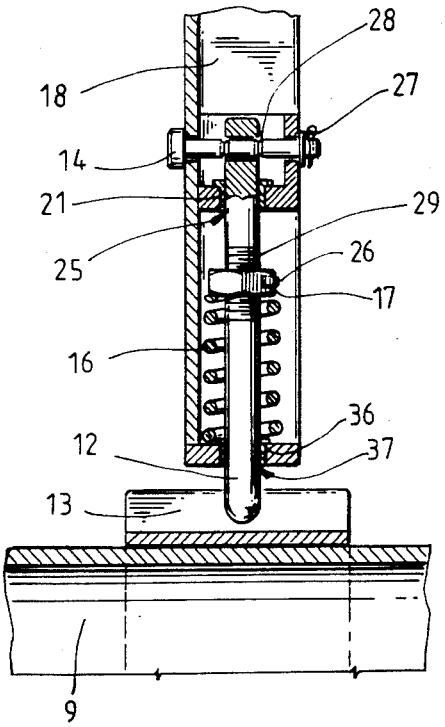
FIG. 6 is a longitudinal sectional view of the wind responsive retractor in an engaging mode.

FIG. 6 is a longitudinal, sectional view of wind responsive retractor 2 in a securing mode. Retaining member 12 is shown inserted in holes 25 and 37 and engaged by bushings 21 and 36. In the engaging mode, retaining member 12 is acted upon by tension adjuster 17 and elastic element 16 which creates a constant force upon retaining member 12. Upon the separation of securing member 14, elastic element 16 and tension adjuster 17 act to withdraw retaining member 12 into the confines of support channel 18.

Securing member 14 is manufactured to be sheared by guide member 20, support channel 18 and retaining member 12 when a specific force is applied thereupon. Securing member 14 can be adjusted to separate when different shearing stresses are applied by varying the size and depth of grooves 28. Grooves 28 in securing member 14 are located to allow for maximum shearing efficiency when retaining member 12 acts upon securing member 14.

Figure 7:
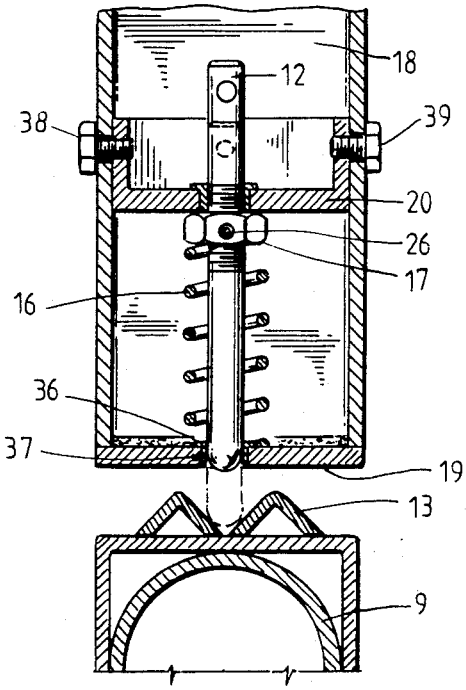
FIG. 7 is a lateral sectional view of the wind responsive retractor in a disengaged mode.

A lateral, sectional view of wind responsive retractor 2 in a disengaged mode is displayed in FIG. 7. Support channel 18 is shown in a spaced relationship to horizontal member 9 and positive clutch mechanism 13. In the disengaged mode, the bottom of support channel 18 and guide plate 19 are able to move freely past positive clutch mechanism 13 and horizontal member 19 with no restriction.

Also, in FIG. 7, retaining member 12 is shown in an engaging mode. In the engaging mode, retaining member 12 engages the trough of positive clutch mechanism 13. It is the contact between positive clutch mechanism 13 and retaining member 12 that secures support channel 18 and signboard 10 in a substantially vertical position until a torque due to a preselected wind load acts against signboard 10. When such a wind load exists upon signboard 10, retaining member 12 is forced up one side of the trough of positive clutch mechanism 13 causing retaining member 12 to separate securing member 14 at grooves 28. When securing member 14 is separated at grooves 28, the force acting upon retaining member 12 by elastic element 16 and tension adjuster 17 causes retaining member 12 to be further withdrawn and secured in support channel 18.

Retaining member 12 is prevented from being withdrawn into support channel 18 to such an extent as to be disengaged with guide plate 19 by tension adjuster 17 acting against guide member 20. Guide member 20 is secured in place by bolts 38 and 39 acting on support channel 18 and guide member 20.

To place the present invention in an operational mode securing member 14 is inserted through the passage created by holes in support channel 18, guide member 20 and retaining member 12. Securing member 14 is inserted in the passage in such a manner as to require retaining member 12 to be flush in the trough of positive clutch mechanism 13. A torque due to wind load on the face of signboard 10 creates two basic forces. One force is perpendicular to retaining member 12 causing retaining member 12 to act against positive clutch mechanism 13. The second force is parallel to retaining member 12 causing retaining member 12, guide member 20 and support channel 18 to act as a shearing device against securing member 14.

The two forces associated with the retaining mechanism for the present invention are unique. The force perpendicular to retaining member 12 and against positive clutch mechanism 13 is a force that is normal to the plane of signboard 10. The second force parallel to retaining member 12 lies in the plane of signboard 10. The force acting against securing member 14 is greatly reduced by the friction of retaining member 12 acting against positive clutch mechanism 13. This reduction in shearing force enables the present invention to use a smaller securing member 14. This is not only more convenient for resetting the device, but also enhances the prospects of better calibrating securing member 14 with respect to the force of the wind against signboard 10. This feature also allows for a securing member 14 that is easily handled and utilized in securing signboard 10.

The present invention can be utilized on new sign structures or can be utilized to modify existing sign structures. The same wind responsive retractor 2 can be used for any predetermined value of wind speed. The only element that must be changed to change the sign release wind speed is shearing member 14. The deeper the grooves 28 in shearing member 14 the lower the wind speed required to release sign 1 and activate wind responsive retractor 2. Thus, the present invention can be utilized in different regions of the country having different wind characteristics.

Securing member 24 can also be in the form of a tension bolt. Such an embodiment is shown in the insert to FIG. 1. A tension bolt could be screwed through sleeve 22 and into a groove in stanchion 23. The tension bolt would be made of a material more malleable than that of stancion 23. Thus, when the torque about the axis of stanchion 23 is sufficiently great, the tension bolt would disfigure, thereby allowing sign 1 to rotate about the axis of stanchion 23.

If during maintenance, a force was to be applied normal to signboard 10 that would cause a shearing force great enough to shear securing member 14 then a safety pin could be utilized. The safety pin can be configured exactly like securing member 14, but without grooves 28. The safety pin can be made of extremely durable and strong material that would be extremely difficult to shear. It could be inserted through the same passage in support channel 18, guide member 20 and retaining member 12 as secruing member 14. After maintenance, the safety pin could be removed and securing member 14 could again be inserted into the passage for securing retaining member 12.

As previously discussed, the present invention also provides a mechanism for protecting retaining member 12, and the sign generally, when signboard 10 swings past positive clutch mechanism 13 and support structure 11. This protection is provided by wind responsive retractor 2. Upon activation of wind responsive retractor 2, elastic element 16 acts against guide plate 19 and tension adjuster 17 causing retaining member 12 to withdraw into support channel 18. Retaining member 12 is withdrawn into support channel 18 to a distance that eliminates the possibility of retaining member 12 coming into contact with positive clutch mechanism 13 or any other part of sign 1. Thus, the sign can pivot freely about upper horizontal member 8 of support structure 11.

In the preferred construction, it is advantageous to have a different securing member 14 for each preselected torque at which the blow-through pivotal sign is to release. For example, a securing member 14 could be machined to release the securing mechanism at wind speeds of 45 miles per hour, 65 miles per hour, 120 miles per hour, etc. To activate the wind responsive retractor, retaining member 12 can be easily extracted from support channel 18 into the trough of positive clutch member 13 against the force of elastic element 16. The force required to pull retaining member 12 out of support channel 18 could be adjusted by tension adjuster 17. Preferably, retaining member 12 could be pulled out of support channel 18 by hand and securing member 14 inserted through the passage in support channel 18, guide member 20 and retaining member 12. Thus, the blow-through pivotal sign could be set to release at any preselected wind speed by merely inserting a different securing member 14.

Additional advantages and modification will readily occur to those skilled in the art. The invention in its broader aspects is therefore not limited to the specific details, representative apparatus, and the illustrative example shown and described. Accordingly, departures may be made from the detail without departing from the spirit or scope of the disclosed general inventive concept.

What is claimed is:

1. A blow-through pivotal sign for preventing damage to advertising structures and the like due to natural forces acting on the signface comprising a signboard attached to a support structure, means for retaining said signboard in a fixed position until a preselected torque due to windload is applied, and a wind responsive retractor for retracting said retaining means to prevent damage thereto after said signboard has been deflected from the fixed position and is swinging freely.

2. The blow-through pivotal sign of claim 1, wherein said means for retaining said signboard comprises:

(a) a retaining member mechanically coupling said signboard and said support structure for securing the position of said signboard until a preselected torque due to windload is applied, (b) a positive clutch mechanism fixedly attached to said support structure for receiving and securing said retaining member when a torque due to windload on the signboard is less than a preselected value, and (c) a securing member for fixedly securing said retaining member until the torque on said pivotal signboard due to the wind force exceeds a preselected value permitting said retaining member to disengage from said positive clutch mechanism for allowing said signboard to be deflected from the fixed position.

3. The blow-through pivotal sign of claim 2, wherein said securing member is a shear pin.

4. The blow-through pivotal sign of claim 2, wherein said securing member is a tension bolt.

5. The blow-through pivotal sign of claim 1, wherein the sign may be deflected along two axes, horizontally and vertically, about components of said support structure.

6. The blow-through pivotal sign of claim 1, further comprising a safety pin operatively associated with said retaining member to restrain the movement thereof inhibiting deflection of said sign when the torque on said signboard is greater than the preselected value.

7. A blow-through pivotal sign to prevent damage due to wind load on outdoor advertising structures and the like comprising:

(a) a support structure comprising an upper and lower horizontal member, two adjacent vertical side members, the opposing members being substantially parallel, and one or more stanchions for supporting said horizontal and vertical members, (b) a signboard, (c) one or more vertical support channels attached to said signboard, (d) means for securing the vertical position of said support channel while allowing said signboard to be pivotally suspended on said upper horizontal member of said support structure where pivotal motion commences only after a preselected torque due to windload is applied to said signboard, (e) a wind responsive retractor associated with the lower end of said support channel in operative relation to said lower horizontal member of said support structure for securing the pivotal motion of said signboard about the axis of said upper horizontal member of said support structure until a preselected torque due to windload is applied, said wind responsive retractor comprising means for completely disengaging the lower end of said support channel with said horizontal member preventing damage thereto as the signboard is allowed to swing freely, (f) a sleeve secured to said lower horizontal member of said support structure and engaged therein said stanchion, said sleeve and said stanchion being mechanically coupled to allow said support structure to pivot about the axis of said stanchion, and (g) means for securing the pivotal motion of said support structure about the axis of said stanchion until a preselected torque due to wind load is applied.

8. The blow-through pivotal sign of claim 7 wherein said means for securing the pivotal motion of said support structure about the axis of said stanchion comprises a shear pin inserted into a bore through said sleeve and said stanchion, substantially perpendicular thereto, said shear pin being of such thickness and material as to separate when a preselected torque due to windload on said signboard is applied.

9. The blow-through pivotal sign of claim 7 wherein said means for securing the pivotal motion of said support structure about the axis of said stanchion comprises a tension bolt engaged with said sleeve to apply pressure to said stanchion sufficient to secure the position of said support structure until a preselected torque due to wind load on said signboard is applied.

10. The blow-through pivotal sign of claim 7 wherein said wind responsive retractor comprises:

(a) a retaining member, (b) an elastic element associated with said retaining member, (c) means for restricting the movement of said retaining member to within the confines of said support channel and to a path parallel to said support channel, (d) a tension adjustor movably secured to said retaining member for acting against said elastic element for withdrawing said retaining member into said support channel, (e) a securing member engaging said support channel and said retaining member for securing said retaining member in a position partially extending from the bottom of said support channel, (f) a positive clutch mechanism for accepting said retaining member and securing the position of said signboard when the windload applied to said signborad creates a torque less than a preselected value and when the windload applied to said signboard creates a torque greater than a preselected value said retaining member acts against said positive clutch mechanism sufficient to force said retaining member into said support channel causing said securing member to separate allowing said elastic element to withdraw said retaining member to a position sufficiently interior said support channel to allow said signboard to swing freely through a vertical position without engaging any resistance.

11. A wind responsive retractor for use and reuse with a blow-through pivotal sign and associated support structure for preventing damage to advertising structures and the like due to windload comprising:

(a) a sign comprising a signboard and a support structure, (b) a retaining member mechanically coupling the signboard and the support structure for securing the position of the signboard until a preselected torque due to windload is applied, (c) an elastic element operatively associated with said retaining member, and (d) said elastic element biasing said retaining member in a retracted position away from support structure for preventing damage to said sign as said signboard is allowed to swing freely.

12. The wind responsive retractor of claim 11 further comprising a positive clutch mechanism for accepting said retaining member and securing the signboard when the torque due to windload on the signboard is less than a preselected value.

13. The wind responsive retractor of claim 12 further comprising a securing member associated with said retaining member and said support structure, both said retaining member and said support structure caused to act against and separate said securing member when the torque due to windload on the signboard is greater than a preselected value causing said positive clutch mechanism to activate said elastic element for securing said retaining member.

* * * * *